United States Patent [19]

Kuwabara

[11] Patent Number: 4,786,587

[45] Date of Patent: Nov. 22, 1988

[54] SILVER HALIDE PHOTOGRAPHIC MATERIAL COMPRISING TWO KINDS OF MONODISPERSE EMULSIONS DIFFERING IN MEAN GRAIN SIZE

[75] Inventor: Ken-ichi Kuwabara, Kanagawa, Japan

[73] Assignee: Fuji Photo Film Co., Ltd., Kanagawa, Japan

[21] Appl. No.: 115,645

[22] Filed: Oct. 26, 1987

Related U.S. Application Data

[63] Continuation-in-part of Ser. No. 845,300, Mar. 28, 1986, abandoned.

[30] Foreign Application Priority Data

Mar. 28, 1985 [JP] Japan ..... 60-64199

[51] Int. Cl.[4] ..... G03C 1/06; G03C 1/02

[52] U.S. Cl. ..... 430/566; 430/264; 430/267; 430/567; 430/598; 430/948

[58] Field of Search ..... 430/264, 267, 566, 567, 430/598, 948

[56] References Cited

U.S. PATENT DOCUMENTS

| | | | |
|---|---|---|---|
| 4,166,742 | 9/1979 | Mifune et al. | 430/568 |
| 4,168,977 | 9/1979 | Takada et al. | 430/446 |
| 4,221,857 | 9/1980 | Okutsu et al. | 430/264 |
| 4,224,401 | 9/1980 | Takada et al. | 430/437 |
| 4,269,929 | 5/1981 | Nothnagle | 430/269 |
| 4,272,606 | 6/1981 | Mifune et al. | 430/264 |
| 4,311,781 | 1/1982 | Mifune et al. | 430/264 |
| 4,385,108 | 5/1983 | Takagi et al. | 430/448 X |

FOREIGN PATENT DOCUMENTS 58137 4/1982 Japan .

*Primary Examiner*—Mukund J. Shah

*Attorney, Agent, or Firm*—Sughrue, Mion, Zinn, Macpeak & Seas

[57] ABSTRACT

A silver halide photographic material comprising at least one negative type silver halide emulsion layer coated on a support, said emulsion comprising two kinds of monodisperse emulsions each having a means grain sizes of not more than 0.5 micron and, differing in mean grain size from each other at least by 0.1 micron, and said photographic material further comprising a hydrazine derivative in at least one photographic layer, whereby negative images of high density and very high contrast can be obtained with a high photographic speed and without black spots.

20 Claims, No Drawings

SILVER HALIDE PHOTOGRAPHIC MATERIAL COMPRISING TWO KINDS OF MONODISPERSE EMULSIONS DIFFERING IN MEAN GRAIN SIZE

This application is a continuation-in-part of Ser. No. 845,300 filed Mar. 28, 1986, now abandoned.

FIELD OF THE INVENTION

The present invention relates to a silver halide photographic material which enables rapid production of super high contrast image, which can be usefully employed in the photomechanical process, using a highly stable processing solution.

BACKGROUND OF THE INVENTION

It is well-known that very high contrast photographic images can be formed using certain silver halides, and methods for forming such photographic images have been employed in the photomechanical process.

One of such known methods involves in using a lith type silver halide photosensitive material which comprises fine-grained silver chlorobromide (of which at least 50 mol% or more is silver chloride) having mean grain size of 0.5 micron or less and a narrow grain size distribution. By processing a material of this type with a hydroquinone-containing developing solution in which the effective concentration of sulfite ion is extremely lowered (generally 0.1 mol/liter or less), line or dot images having clear distinction between the image areas and the nonimage areas (that is, high contrast) and high density in blackened areas can be produced. In this method, however, the developing solution used is quite unstable to air oxidation because of its low sulfite ion concentration. Therefore, in the present situation, it is used with many efforts and various devices for keeping the solution activity stable.

Such being the case, image-forming systems which can solve the instability of image formation using the above-described developing method (lithographic developing system) and can provide super high contrast photographic characteristics in spite of the development with a processing solution having excellent storage stability have been desired, and which the intention of satisfying this desire, U.S. Pat. Nos. 4,166,742, 4,168,977, 4,221,857, 4,224,401, 4,243,739, 4,272,606 and 4,311,781 have proposed a novel system that a surface latent image type silver halide photographic material in which a particular acylhydrazine compound is incorporated is processed with a developing solution excellent in storage stability, which has a pH value of from 11.0 to 12.3 and contains 0.15 mol/liter or more of a preservative of the sulfuric acid type. This enables a super high contrast negative image having a gamma value of 10 or above. This image-forming system has the merit of making it feasible to form high contrast images using silver iodobromides or silver chloroiodobromides, as well as silver chlorobromides having high silver chloride contents, as compared with conventional systems for forming high contrast images in which only silver chlorobromides of high silver chloride contents can be used.

However, it sometimes happens that this novel image-forming system causes undesirable phenomenon of black spots due to infectious development occurring simultaneously with marked increases in photographic speed and contrast. The generation of such black spots is a problem remaining to be solved in the photomechanical processes.

The term black spots refers to fine specks of developed silver which appear in the unexposed areas to be normally non-image areas. The black spots tend to appear in great numbers, particularly when exhaustion of the processing solution with the lapse of time causes the rise in pH or so on. Under these circumstances, considerable efforts have been attempted to prevent the generation of the black spots, but improvements with respect to the occurrence of black spots have frequently been accompanied by decreases in photographic speed and lowering of image contrast. Therefore, such a system as to suppress the generation of black spots as it attains highly sensitive and super high contrast photographic characteristics has been awaited.

On the other hand, a silver halide photographic material, the photographic density attained by a per-unit-area amount of developed silver becomes, in general, higher with smaller size silver halide grains, whereas the sensitivity of silver halide becomes, in general, higher with greater size silver halide grains. Therefore, it is necessary to employ a silver halide emulsion having a large grain size in a larger amount per unit area if one wishes to obtain a photosensitive material having high sensitivity and high photographic density. A photosensitive material containing a large amount of silver halide emulsion, however, requires much time at the stage of development, and further for effecting fixation, washing and drying, to result in a loss of rapid processability. In addition, silver is an expensive resource, and its production and reserves are limited in quantities. Consequently, it is requested to produce a photosensitive material using the smallest possible amount of silver.

From these viewpoints, investigations have been undertaken for many years to produce silver halide photosensitive materials of both high image density and high photographic speed using a reduced amount of silver. As a result of such investigations, Japanese patent application (OPI) 58137/82 (The term "OPI" indicates an unexamined published patent application open to public insepection) discloses the method that the mixture of a high photographic speed emulsion having grain sizes of 0.7 microns or more with an emulsion having grain sizes of 0.4 microns or less is processed in the presence of a hydrazine compound to acquire the photographic characteristics of high photographic speed and high contrast. However, this method also cannot attain such high contrast (gamma of not less than 10) and high photographic density as is some times needed in the photomechanical process, and further suffers from marked generation of black spots, as cited for comparison in the Example.

SUMMARY OF THE INVENTION

An object of the present invention is to provide a silver halide photographic material which generates black spots in considerably reduced numbers, has high photographic speed and produces images of high contrast and high photographic density.

The above-described object is attained with a negative type silver halide photographic material which has on a support a silver halide emulsion layer containing, as a minimum, two kinds of monodisperse emulsions, each having a mean grain size of not more than 0.5 micron, and differing in mean grain size from each other by at least 0.1 micron and said photographic material further contains a hydrazine derivative in at least one layer.

DETAILED DESCRIPTION OF THE INVENTION

A silver halide emulsion present in the photographic emulsion layer to be employed in the present invention is constituted with two kinds of monodisperse emulsions which each has a mean grain size of 0.5 micron or less. The foregoing term "monodisperse emulsion" is intended to include emulsions having such a grain size distribution that grains accounting for 90 percent of the whole number of silver halide grains in the emulsion have their respective sizes within the range of ±40% of the mean grain size. These two monodisperse emulsions must differ in mean grain size from each other by at least 0.1 micron, preferably from 0.1 to 0.3 micron. Also it is to be desired that one should have a mean grain size of not more than 0.3 micron and the other should have a mean grain size of at least 0.3 micron. It is also preferable that the mean grain size is not less than 0.1 micron. The two monodisperse emulsions are generally mixed so that the fraction of the finer-grained silver halide may range from 40 to 90% by weight, particularly preferably from 50 to 80% by weight based on the weight of the total amount of silver halide in the monodisperse emulsions.

In the present invention, photographic performances should be well balanced with respect to all of sensitivity, gamma, Dmax and black spots. Even if the photographic material according to the prior art provides a gamma higher than 10, when a great number of black spots occur or only a low Dmax is obtained, such a photographic material cannot be subjected to practical use.

That is, in the present invention, the contrast should only be higher than 10, the Dmax should be at least 4.0 (an increase in Dmax of less than 1 is not important in the present invention), the sensitivity should be properly high and the grade of the black spots should be less than 3.

The preferred relationship of emulsion grain size and amounts of such emulsion is set forth below where the larger grain size is S1 and the finer grain size is S2.

| | | |
|---|---|---|
| (1) | $0.4\ \mu m < S1 \leqq 0.5\ \mu m$ | 10–30% |
| | $0.1\ \mu m \leqq S2 \leqq 0.3\ \mu m$ | 90–70% |
| (2) | $S1 < 0.4\ \mu m$ | 10–60% |
| | $S2 \leqq S1 - 0.1\ \mu m$ | 90–40% |
| (3) | (most preferable) | |
| | $0.3\ \mu m \leqq S1 \leqq 0.4\ \mu m$ | 10–50% |
| | $0.1\ \mu m \leqq S2 \leqq 0.3\ \mu m$ | 90–50% |

Percents(%) are by weight based on the weight of the total amount of silver halide in the monodisperse emulsions.

The minimum preferred size of the finer grained emulsion is 0.1μ.

The silver halide emulsion to be employed in the present invention is not particularly restricted as to the halide composition. Any of compositions including silver chloride, silver bromide, silver chlorobromide, silver iodobromide, silver iodochloride and silver iodochlorobromide may be employed. Two kinds of monodisperse emulsions may have the same halide composition, or may differ in halide composition. In addition, they must be used together with silver halide emulsions other than the foregoing monodisperse emulsions within limits not to mar the effects of the present invention. The emulsion other than the monodisperse emulsion of the present invention is usually added in an amount of not more than 10% by weight based on the weight of the total amount of silver halide in the emulsion.

The silver halide emulsions employed in the present invention can be prepared using various methods known in the art of silver halide photographic materials. For example, the methods described in P. Glafkides, *Chimie et Physique Photographique* (Paul Montel, 1967), G. F. Duffin, *Photographic Emulsion Chemistry* (The Focal Press, 1966), V. L. Zelikman et al, *Making and Coating Photographic Emulsion* (The Focal Press, 1964), and so on can be employed. Suitable methods for reacting a water-soluble silver salt (e.g., a aqueous solution of silver nitrate) with a water-soluble halide include, e.g., a single jet method, a double jet method or a combination thereof. Also, the so-called controlled double jet method, in which the pAg of the liquid phase in which silver halide grains are to be precipitated is maintained constant, may be employed. Further, silver halide grains can be formed using a so-called silver halide solvent, such as ammonia, a thioether, a tetrasubstituted thiourea or so on.

Silver halide emulsions having a regular crystal form and a narrow distribution of grain sizes can be prepared with ease using the controlled double jet method or the grain-forming method utilizing a silver halide solvent. Accordingly, these methods are effective means for making the emulsions to be employed in the present invention.

The silver halide grains in the photographic emulsions of the present invention may have a regular crystal form, or an irregular crystal form such as that of a sphere, a plate or so on.

The silver halide grains may have different phases between the inside thereof and the surface portion thereof or may have homogeneous phase throughout the grain.

Cadmium salts, zinc salts, lead salts, thallium salts, iridium salts or complexes thereof, rhodium salts or complexes thereof, iron salts or complexes and/or the like may be added to the silver halide emulsion of the present invention in the process of producing silver halide grains or in the process of physical ripening silver halide grains. These compounds are used for stabilizing, increasing of contrast, inhibiting of fogging, and improving of reciprocity low failure.

Removal of the soluble salts from the silver halide emulsion is, in general, carried out after the formation of the silver halide grains or after physical ripening thereof. The removal can be effected using noodle washing method which comprises gelling the gelatin, or using a precipitation process (thereby causing flocculation of the emulsion) making use of a precipitant such as a polyvalent anion-containing inorganic salt (e.g., sodium sulfate), an anionic surface active agent, an anionic polymer (e.g. polystyrene sulfonic acid), or a gelatin derivative (e.g. an aliphatic acylated gelatin, an aromatic acylated gelatin, an aromatic carbamoylated gelatin or the like).

The silver halide emulsion of the present invention may be a chemically sensitized emulsion or a chemically unsensitized emulsion. Chemical sensitization can be carried out using known processes (e.g., sulfur sensitization, reduction sensitization, gold sensitization, etc.) individually or as a combination thereof.

Gold sensitization is a representative of sensitizations with noble metals, and gold compounds, mainly gold complexes, are employed therein. Of course, noble metal complexes such as those of platinum, palladium, iridium, etc., other than gold metal complexes, can be employed for sensitization. Specific examples of these metal complexes are disclosed in U.S. Pat. No. 2,448,060, British Pat. No. 618,061, and so on.

Examples of suitable sulfur sensitizers which can be used include sulfur compounds contained in gelatin, and various sulfur compounds such as thiosulfates, thioureas, thiazoles, rhodanines and so on. Specific examples of such sulfur sensitizers are disclosed in U.S. Pat. Nos. 1,574,944, 2,278,947, 2,410,689, 2,728,668, 3,501,313 and 3,656,955.

Examples of reducing sensitizers include stannous salts, amines, formamidine sulfinic acid, silane compounds and so on, and specific examples of these sensitizers are described in U.S. Pat. Nos. 2,487,850, 2,518,698, 2,983,609, 2,983,610 and 2,694,637.

These photographic emulsions can further be optically sensitized for the purposes of increasing the photographic speed and imparting spectral sensitivity in the desired wavelength region. Sensitization can be carried out using sensitizing dyes such as cyanine dyes, merocyanine dyes and so on individually or as a combination thereof to result in spectral sensitization or supersensitization.

Examples of applicable sensitizing techniques are described in U.S. Pat. Nos. 2,688,545, 2,912,329, 3,397,060, 3,615,635 and 3,628,964, Japanese patent publications 4936/68 and 14030/69, Japanese patent application (OPI) 52050/80, and so on.

As the hydrazine derivatives known compounds which are conventionally used to obtain a high speed and a high contrast photographic emulsion can be used in the present invention.

The amount of the hydrazine derivative should be a contrast-enhancing amount and more specifically, it should be an amount sufficient to make the contrast at least 10 but should not exceed an amount which is able to sufficiently improve the photographic characteristics sufficiently. See, for example, Table 1 and compare, for example, Sample 2 and Sample 6.

Where the amount of the emulsion having a larger grain size is used in a larger amount and when sone hydrazines are used in a larger amount than a proper amount, the grade of preventing black spots will be poor. However, it should be noted that even in such a case, if the amount of hydrazine derivative is reduced to some extent, the grade of the black spots can be made good.

On the other hand, the lowering of the grade of black spots can be avoided, to some extent, by selecting a lower ratio of the emulsion having a greater emulsion size. If the ratio of the emulsion having a larger grain size is lowered, rather than the amount of the hydrazine compound being reduced, a high grade of black spots can be obtained.

The preferred relationship of the emulsion grain sizes and the amounts of each emulsion has earlier been set forth.

Preferred examples of hydrazine derivatives to be employed in the present invention include compounds represented by the following formula (I):

$$R_1—NHNH—G—R_2 \quad (I)$$

wherein $R_1$ represents an aliphatic group, an aromatic group or a substituted or unsubstituted saturated hererocyclic group; $R_2$ represents a hydrogen atom, a substituted or unsubstituted alkyl group, a substituted or unsubstituted aryl group, a substituted or unsubstituted aralkyl group, a substituted or unsubstituted alkoxy group, or a substituted or unsubstituted aryloxy group; and G represents a carbonyl group, a sulfonyl group, a sulfoxy group, a phosphoryl group, or an N-substituted or unsubstituted iminomethylene group ($NH=C<$).

In formula (I), an aliphatic group represented by $R_1$ is preferably one which contains from 1 to 30 carbon atoms, and particularly preferably a straight or branched chain, or cyclic alkyl group containing from 1 to 20 carbon atoms.

A saturated heterocyclic group represented by $R_1$ is preferably a 3–10 membered heterocyclic ring containing at least one of O, N and S atoms in the heterocyclic group. These alkyl groups and heterocyclic groups may have a substituent such as an aryl group preferably having from 6 to 20 carbon atoms, an alkoxy group preferably having from 1 to 20 carbon atoms, a sulfoxy group preferably having from 1 to 20 carbon atoms, a sulfonamido group preferably having from 0 to 20 carbon atoms, a carbonamido group preferably having from 1 to 20 carbon atoms, or a heterocyclic group as described hereinabove for the saturated heterocyclic group.

An aromatic group represented by $R_1$ is a monocyclic or bicyclic aryl group, or an unsaturated heterocyclic group preferably is a 5–6 membered ring having at least one of O, N and S atoms. Herein, the unsaturated heterocyclic group may be fused together with a monocyclic or bicyclic aryl group to form a heteroaryl group. Preferable examples of suitable aromatic groups include a phenyl group, a naphthyl group, a pyridyl group, a pyrimidinyl group, an imidazolyl group, a pyrazolyl group, a quinolinyl group, an isoquinolinyl group, a benzimidazolyl group, a thiazolyl group, a benzothiazolyl group and the like. Of these groups, those containing a benzene ring are more desirable.

Particularly suitable groups for $R_1$ are aryl groups. Aryl groups and unsaturated heterocyclic groups represented by $R_1$ may have a certain substituent; representative substituents include straight or branched chain, or cyclic alkyl groups (preferably those containing from 1 to 20 carbon atoms), aralkyl groups (preferably monocyclic and bicyclic ones whose alkyl moiety contains from 1 to 3 carbon atoms), alkoxy groups (preferably those containing from 1 to 20 carbon atoms), mono- or di-substituted amino groups (preferably those substituted with an alkyl group containing 1 to 20 carbon atoms (in the case of a disubstituted amino group the total carbon number of the substituents is at most 20), acylamino groups such as a substituted or unsubstituted alkylcarboxyamino group (preferably having from 2 to 30 carbon atoms), a substituted or unsubstituted arylcarboxyamino group (preferably having from 7 to 30 carbon atoms), substituted or unsubstituted alkyl- or arylsulfonamido groups (preferably those containing from 1 to 30 carbon atoms and 6 to 30 carbon atoms, respectively), mono-, di- or tri-substituted or unsubstituted ureido groups (preferably those containing from 1 to 30 carbon atoms) and so on. Examples for substituents of the alkyl of aryl carboxy and sulfonamido groups include an alkoxy group having from 1 to 20 carbon atoms, an aryloxy group having from 6 to 26 carbon atoms, an alkylthio group having from 1 to 20 carbon atoms, an alkyl sulfonyl group having from 1 to 20 carbon atoms, and a halogen atom (e.g., F, Cl, Br and I). Examples for substituents of the ureido group include a substituted or unsubstituted straight, branched or cyclic alkyl group having from 1 to 30 carbon atoms in the alkyl moiety, a substituted or unsubstituted phenyl and naphthyl group. Examples for substituents of these groups include an alkoxy group having from 1 to 20 carbon atoms, an aryloxy group having from 6 to 20 carbon atoms, an alkylthio group having from 1 to 20 carbon atoms, an alkylsulfonyl group having from 1 to 20 carbon atoms, an alkyl and aryl carbon amido group having from 1 to 20 and 7 to 20 carbon atoms, respectively, an alkyl- and arylcarbamoyl group having from 1 to 20 and 7 to 20 carbon atoms, respectively, an alkyl- or aryl sulfamoyl group having from 1 to 20 and 6 to 20 carbon atoms, respectively, a hydroxy group, —COOM, —$SO_3M$ (M: H, an alkali metal atom, —$NH_4$), an aryl group having from 6 to 20 carbon atoms, and an alkyl- and arylsulfoxy group having from 1 to 20 and 6 to 20 carbon atoms, respectively, and a halogen atom (i.e., F, Cl, Br and I). Two of these groups may be bonded to form a ring.

An alkyl group represented by $R_2$ is preferably one which contains from 1 to 4 carbon atoms, and may be substituted with a halogen atom (i.e., F, Cl, Br or I), a cyano group, —COOM, —$SO_3M$ (M: H, an alkali metal atom or —$NH_4$) an alkoxy group having from 1 to 20 carbon atoms, a phenyl group, an aryloxy group having from 6 to 26 carbon atoms, an alkylthio group having from 1 to 20 carbon atoms, a hydroxyphenyl group, a carbonamido group such as an alkyl- or arylcarbonamido group having from 2 to 20 and 7 to 20 carbon atoms, respectively, a sulfonamido group such as alkyl- or arylsulfonamido group having from 1 to 20 and 6 to 20 carbon atoms, respectively.

An unsubstituted or substituted aryl group represented by $R_2$ is a monocyclic or bicyclic aryl group preferably having from 6 to 20 carbon atoms, e.g., one containing a benzene ring. An unsubstituted or substituted aralkyl group represented by $R_2$ preferably has 7 to 26 carbon atoms. The aryl and aralkyl groups may be substituted, for example, with a halogen atom (i.e., F, Cl, Br and I), an alkyl group preferably having from 1 to 20 carbon atoms, a cyano group, —COOM, —$SO_3M$ (M: H, an alkali metal atom, —$NH_4$), an alkylthio group preferably having from 1 to 20 carbon atoms, a hydroxy group, a sulfamoyl group preferably having from 0 to 20 carbon atoms and a sulfonamido group preferably having from 0 to 20 carbon atoms.

Unsubstituted or substituted alkoxy group represented by $R_2$ include those containing 1 to 8 carbon atoms, which may be substituted with a halogen atom (i.e., F, Cl, Br, and I), an aryl group preferably having from 6 to 26 carbon atoms or so on.

An unsubstituted or substituted aryloxy group represented by $R_2$ is preferably a monocyclic one having from 6 to 26 carbon atoms, which may substituted with a halogen atom (i.e., F, Cl, Br and I) and so on.

Of the groups represented by $R_2$, those preferred over others include a hydrogen atom, a methyl group, a methoxy group, an ethoxy group, and a substituted or unsubstituted phenyl group in a case where G represents a carbonyl group. In particular, a hydrogen atom is desirable for $R_2$.

In another case where G represents a sulfonyl group, a group represented by $R_2$ is preferably a methyl group, an ethyl group, a phenyl group or a 4-methylphenyl group, particularly preferably a methyl group.

In still another case where G represents a phosphoryl group, a group represented by $R_2$ is preferably a methoxy group, ethoxy group, a butoxy group, a phenoxy group or a phenyl group, and particularly preferably a phenoxy group.

In a further case where G represents a sulfoxy group, a group represented by $R_2$ is preferably a cyanobenzyl group, a methylthiobenzyl group or the like, and it is preferably a methyl group, an ethyl group, or a substituted or unsubstituted phenyl group when G represents an N-substituted or unsubstituted iminomethyulene group.

In addition, groups represented by $R_1$ and $R_2$, respectively, may be those containing such a ballast group as to be used commonly in nondiffusible photographic additives, e.g., couplers, etc. The ballast group includes those which contain 8 or more carbon atoms and which substantially are not harmful to photograhic properties, and can be chosen from alkyl groups, alkoxy groups, phenyl groups, alkylphenyl groups, phenoxy groups, alkylphenoxy groups and so on.

$R_1$ or $R_2$ may be a group in which such a moiety as to enhance the absorbing power of the compound of the formula (I) toward the individual surfaces of silver halide grains is incorporated. As examples of such an adsorptive group, mention may be made of those described in U.S. Pat. No. 4,385,108, which include a substituted or unsubstituted thiourea groups (examples for substituents are the same as for the above-described ureido group), heterocyclic thioamido groups represented by formula

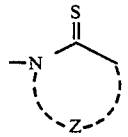

wherein Z represents an atomic group necessary for forming a 5- or 6-membered heterocyclic ring; a mercapto-heterocyclic groups which is a 5- or 6-membered ring containing at least one of O, N and S atom in the heterocyclic ring and which may be fused with a benzene ring; triazolyl groups (such as 1,2,3- or 1,2,4-triazolyl groups and benzotriazolyl group).

The most fevorable groups as G in the formula (I) is a carboxyl group.

The above described substituents may be further substituted with a substituent such as that described for the aryl group represented by $R_1$.

Preferred hydrazine derivatives are also as follows.

Compounds represented by $R_1$—NHNH—G—$R_2$, wherein G is a CO group, $R_2$ is a hydrogen atom, and $R_1$ represents an aryl group having a substituent at the p-position.

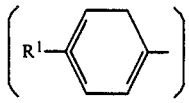

That is, compounds represented by:

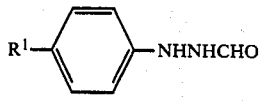

Preferred $R^1$ groups are as follows:

Substituted amino group preferably substituted with at least one alkyl group having 1 to 20 carbon atoms, acylamino groups preferably having 2 to 30 carbon atoms, sulfonamido groups preferably having 1 to 30 carbon atoms, ureido groups preferably having 1 to 30 carbon atoms, and thiourea groups preferably having 1 to 30 carbon atoms.

Specific examples of the compounds represented by the formula (I) are illustrated below. However, the present invention should not be contrued as being limited to the following examples.

I-1

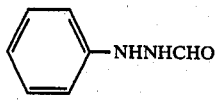

I-2

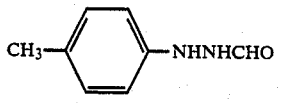

I-3

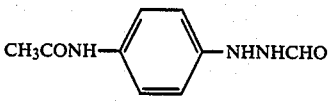

I-4

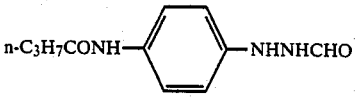

I-5

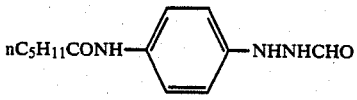

I-6

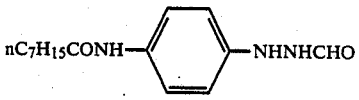

I-7

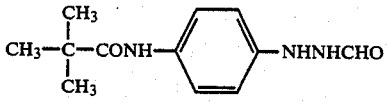

I-8

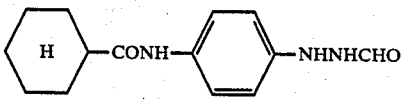

I-9

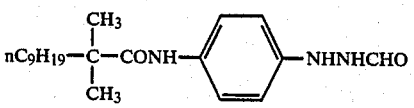

I-10

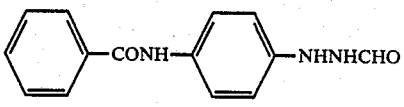

I-11

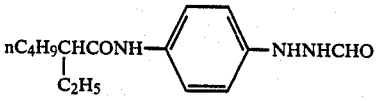

I-12

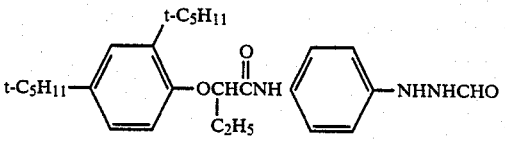

I-13

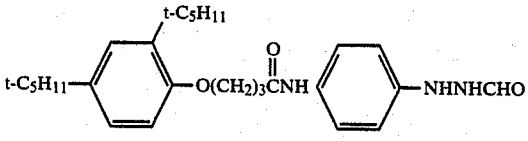

I-14

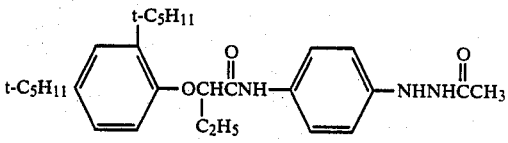

I-15

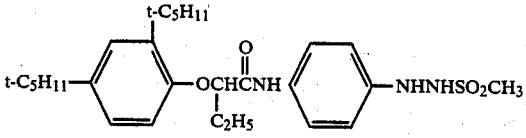

I-16

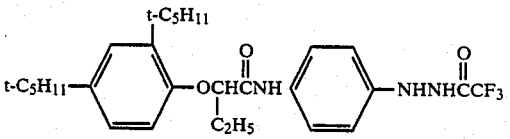

I-17

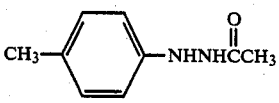

I-18

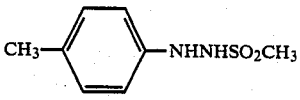

I-19

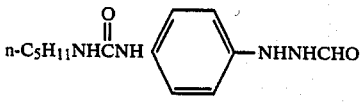

I-20

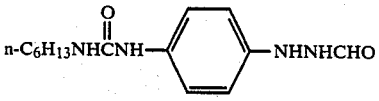

I-21

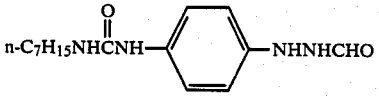

I-22

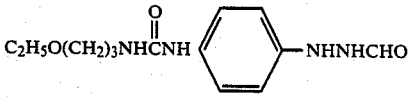

-continued

I-23

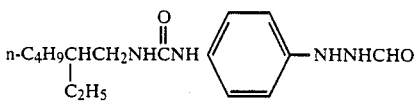

I-24

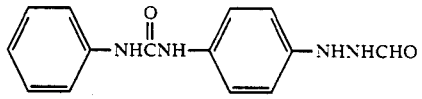

I-25

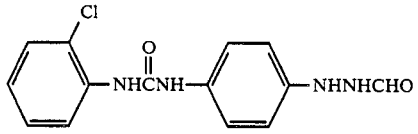

I-26

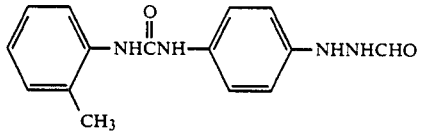

I-27

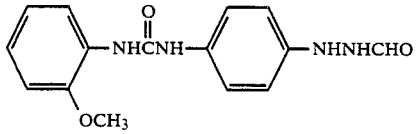

I-28

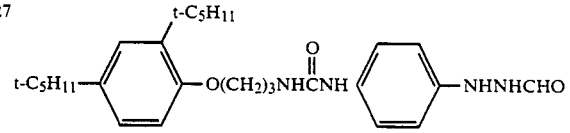

I-29

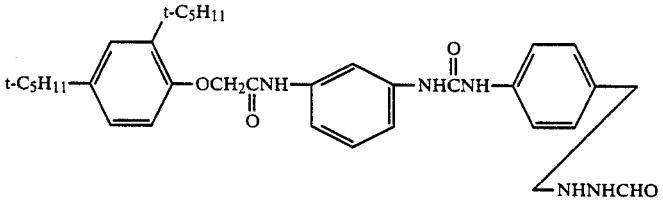

I-30

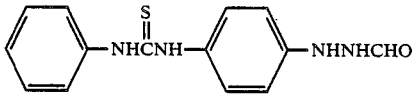

I-31

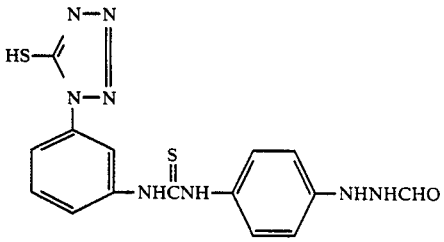

I-32

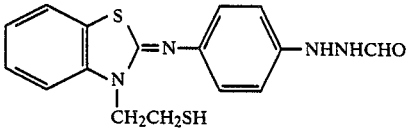

I-33

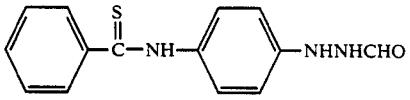

I-34

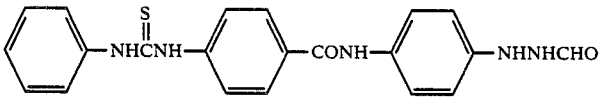

I-35

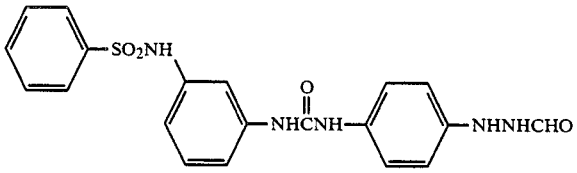

Furthermore, arylhydrazides containing a sulfinic acid residue attached to their hydrazo moiety, which are described in U.S. Pat. No. 4,478,928 can also be used. The arylhydrazides are represented by formula (II)

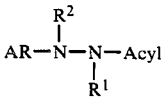

(II)

wherein:

"Acyl" is an acyl group,

"Ar" is an aryl group, $R^1$ represents a hydrogen atom and sulfinic acid radical substituent, and $R^2$ is chosen to be a sulfinic acid radical substituent when $R^1$ is a hydrogen atom and a hydrogen atom when $R^1$ is a sulfinic acid radical.

Examples for the arylhydrazides include 1-(4-aminophenyl)-2-formyl-2-(4-methylphenylsulfonyl)hydrazine, 1-{4-[2-(2,4-bis-t-amylphenoxy)butanamido]- phenyl}-2-formyl-2-(4-methylphenylsulfonyl)hydrazine, 1-formyl-2-(4-methylphenylsulfonyl)-2-[4-(3-methyl-2-thioureido)phenyl]hydrazine, 1-formyl-2-(4-methylphenylsulfonyl)-2-[4-(3-phenylureido)phenyl]-hydrazine, 1-benzoyl-2-(4-methylphenylsulfonyl)-2-phenyl hydrazine.

In the present invention the hydrazine compound is incorporated in a photographic layer such as a silver halide emulsion layer and an auxiliary hydrophilic layer, such as a protective layer and an interlayer. When the compound is incorporated in an auxiliary layer it is preferable to incorporate it into the layer adjacent to a silver halide emulsion layer. It is most preferable to incorporate the compound to the above-described monodisperse silver halide emulsion layer.

The hydrazine compound is incorporated in an amount ranging preferably from $1\times10^{-6}$ mole to $5\times10^{-2}$ mole, particularly preferably from $1\times10^{-5}$ mole to $2\times10^{-2}$ mole, per mole of silver halide in the photographic material.

Incorporation of the compound into a photographic material can be carried out by preparing an aqueous solution thereof when the compound is soluble in water, or dissolving the compound in a water-miscible organic solvent such as an alcohol (e.g., methanol, ethanol, etc.), an ester (e.g., ethyl acetate), a ketone (e.g., acetone) or the like when it is insoluble in water, and then adding the resulting solution to a silver halide emulsion or a hydrophilic colloidal solution.

It is preferable to add a solution of the compound to a silver halide emulsion at the conclusion of the chemical ripening, though the addition can be carried out at any time from the beginning of chemical ripening upto just before the coating step. In particular, it is advantageous to add it to the coating composition ready to be coated.

The photographic emulsions to be employed in the present invention can contain a wide variety of compounds for purposes of preventing fog or stabilizing photographic functions during production, storage, or photographic processing, with specific examples including azoles such as benzothiazolium salts, nitroimidazole, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, mercaptotetrazoles (especially 1-phenyl-5-mercaptotetrazole), and so on; mercaptopyrimidines; mercaptotriazines; thioketo compounds such as oxazolidinethione; azaindenes such as triazaindenes, tetraazaindenes (especially 4-hydroxy-substituted (1,3,3a,7)-tetraazaindenes), pentaazaindenes, and so on; and compounds which have been known as antifoggants or stabilizers, such as benzenethiosulfonic acids, benzenesulfinic acid, benzenesulfonic acid amide, and so on.

Of these compounds, benzotriazoles (e.g., 5-methylbenzotriazole) and nitroindazoles (e.g., 5-nitroindazole) are particularly preferred over others. Also, these compounds may be added to a processing solution.

The photographic material of the present invention may contain inorganic or organic hardeners in photographic emulsion layers and other hydrophilic colloid layers. Suitable examples of hardeners that can be used include chromium salts (e.g., chrome alum, chromium acetate, etc.), aldehydes (e.g., formaldehyde, glyoxal, glutaraldehyde, etc.), N-methylol compounds (e.g., dimethylol urea, methylol dimethylhydantoin, etc.), dioxane derivatives (e.g., 2,3-dihydroxydioxane, etc.), active vinyl-containing compounds (e.g., 1,3,5-triacryloylhexahydro-s-triazine, 1,3-vinylsulfonyl-2-propanol, etc.), active halogen-containing compounds (e.g., 2,4-dichloro-6-hydroxy-s-triazine, etc.), halogenoformylacrylic acids (e.g., mucochloric acid, mucophenoxychloric acid, etc.), and so on. These hardeners can be used alone or in combination.

The photographic emulsion layers or other hydrophilic colloid layers of the photosensitive material prepared in accordance with the present invention may contain surface active agents for various purposes, such as coating aids, prevention of electrification, improvement in slippability, dispersion by emulsifying, prevention of adhesion, and improvements in photographic characteristics (e.g., acceleration of development, increase in contrast, sensitization, and so on).

Examples of surface active agents which can be employed include nonionic surface active agents such as saponin (steroid type), alkylene oxide derivatives (e.g., polyethylene glycol, polyethylene glycol/polypropylene glycol condensates, polyethylene glycol alkyl ethers or polyethylene glycol alkyl aryl ethers, polyethylene glycol esters, polyethylene glycol sorbitane esters, polyalkylene glycol alkylamines or amides, polyethylene oxide adducts of silicone, etc.), glycidol derivatives (e.g., alkenylsuccinic acid polyglycerides, alkylphenol polyglycerides, etc.), fatty acid esters of polyhydric alcohols, alkyl esters of sugar, and so on; anionic surface active agents containing acid groups (e.g., carboxyl group, a sulfo group, a phospho group, a sulfate group, a phosphate group, etc.), such as alkylcarboxylates, alkylsulfonates, alkylbenzenesulfonates, alkylnaphthalenesulfonates, alkylsulfates, alkylphosphonates, N-acyl-N-alkyltauric acid, sulfosuccinates, sulfoalkylpolyoxyethylene alkyl phenyl ethers, polyoxyethylene alkylphosphates, etc.; amphoteric surface active agents such as amino acids, aminoalkylsulfonates, aminoalkylsulfates, aminoalkylphosphates, alkylbetaines, amine oxides, etc.; and cationic surface active agents such as alkylamines, aliphatic or aromatic quaternary ammonium salts, heterocyclic quaternary ammonium salts such as pyridinium, imidazolium and so on, aliphatic or hetero ring-containing phosphonium or sulfonium salts, and so on.

The photographic material of the present invention can contain a dispersion of a water insoluble or slightly soluble synthetic polymer in photographic emulsion layers or other hydrophilic colloid layers for the purpose of improvement in dimensional stability and so on. Suitable examples of such polymers include those containing as constituent monomers an alkyl(meth)acrylate, an alkoxyalkyl(meth)acrylate, a glycidyl(meth)acrylate, (meth)acrylamide, a vinyl ester (e.g., vinyl acetate), an acrylo nitrile, an olefin, a styrene and so on individually or in combination of two or more thereof, or in combination of one or more of the above-described monomer with acrylic acid, methacrylic acid, and $\alpha,\beta$-unsaturated dicarboxylic acid, a hydroxyalkyl(meth)acrylate, a sulfoalkyl(meth)acrylate, a styrenesulfonic acid, and so on.

In carrying out the photographic processing of the silver halide photographic material of the present invention, it is unnecessary to use a conventional hydroquinone-type developing solution in which the effective concentration of sulfite ion is extremely low (lithographic developer), or a high alkaline developer having a pH value near to 13 as are described in U.S. Pat. No.

2,419,975. Super high contrast negative images can be formed by processing the photographic material of the present invention preferably with the developing solution described below.

A developing solution which can be used in the present invention is one which contains a developer of the dihydroxybenzene type as a main developing agent and a developer of the P-aminophenol or 1-phenyl-3-pyrazolidone type as an auxiliary developing agent. Therein, it is to be desired that the main developing agent should be contained in an amount of 0.05 to 0.5 mol/liter, and the auxiliary developing agent should be contained in an amount of not more than 0.06 mol/liter.

In addition, a sulfite preservative such as sodium sulfite, potassium sulfite, lithium sulfite, sodium bisulfite, potassium metabisulfite, formaldehyde sodium bisulfite or the like is used preferably in an amount of 0.15 mol/liter or more, and more preferably 0.4 mol/liter or more and not more than 2.5 mol/liter for the purpose of ensuring the keeping stability of the developing solution.

As for the pH of the developing solution, the pH is preferably not less than 9.5 and 10.5 to 12.3 is more preferred, and there is no need to use a developing solution having a very high value near to 13. Alkali agents used for adjusting the pH of the developing solution to a desired value are usual water-soluble inorganic salts of alkali metals (e.g., sodium hydroxide, potassium hydroxide, sodium carbonate, potassium tertiary phosphate, etc.), and described in U.S. Pat. No. 4,269,929. Also, alkanol amines and the like can be used for achieving a desired pH value.

In accordance with the present invention, super high contrast negative-gradient photographic characteristics like a gamma value over 10 can be obtained by carrying out a rapid access processing (development time: 15 to 60 seconds) using a stable developing solution as described above. A processing temperature to be employed in the present invention is chosen from the range of 18° C. to 50° C.

A fixing solution which can be used includes those having conventionally used compositions. Suitable fixing agents contained in the fixing solutions include thiosulfates, thiocyanates, and other organic sulfur compounds which have been known to have a fixing effect. The fixing solutions may contain, for example, a water-soluble aluminum salt as a hardener.

It is preferred to use an automatic developing machine in the processing of the present invention. In this case, even a short time of from 90 to 120 seconds suffices to provide super high contrast negative-gradient photographic characteristics through the operations of admitting a photosensitive material into an automatic developing machine and taking it out from the machine after all the steps including development, fixation, washing and drying are finished.

As illustrated above, a characteristic feature of the present invention involves in mixing a fine-grained slow emulsion with a high speed emulsion, whereby the extremely useful effect that the silver halide photographic material can provide images of high density and high contrast with high photographic speed, and further whereby the generation of black spots therein is considerably reduced, is fully achieved.

The present invention is illustrated in greater detail by reference to the following example.

EXAMPLE

An aqueous solution of silver nitrate and an aqueous solution containing potassium bromide and potassium iodide were mixed in the presence of ammonia as the pAg of the resulting mixture was kept at 7.9 according to a double jet method. The thus obtained silver halide emulsion was a monodisperse emulsion of silver iodobromide grains having a cubic form and a mean size of 0.2 micron (silver iodide content: 2 mole %, silver bromide content: 98 mole %) (Emulsion A). Separately, an aqueous solution of silver nitrate and an aqueous solution of potassium bromide were mixed in the presence of ammonia as the pAg of the resulting mixture was kept at 7.9 according to a double jet method. Thus, a monodisperse cubic-shaped silver bromide emulsion having a mean grain size of 0.35 micron (Emulsion B) was obtained.

Both of Emulsion A and Emulsion B were desalted using a flocculation process after the grain formation, and then spectrally sensitized by adding a sensitizing dye (sodium salt of 5,5'-dichloro-3,3'-di(3-sulfopropyl)-9-ethyl-oxacarbocyanine) thereto in amounts of $6\times10^{-4}$ mole and $4.5\times10^{-4}$ mole per mole of silver, respectively.

Further, 4-hydroxy-6-methyl-1,3,3a,7-tetrazaindene was added in an amount of $6\times10^{-3}$ mol per mole of silver to each of the emulsions as stabilizer.

These emulsions A and B were mixed in ratios set forth in Table 1 by weight on the basis of silver halide, and thereto were added the compounds represented by the formula (I) in their respective amounts as shown in Table 1. (Grain size distributions of the mixed emulsions corresponding to sample numbers (2) and (3) were measured, and the grain size distribution curve having peaks around 0.2 micron and 0.35 micron, respectively, was obtained).

Furthermore, an alkylbenzenesulfonate (as surface active agent) and a vinylsulfonic acid type hardener were added to each of the emulsions having sample numbers (1) to (20), and the resulting emulsions were adjusted to pH 5.8.

On a 100 μ-thick polyethylene terephthalate film support was coated each of the thus prepared emulsions at a coverage of 3.0 g/m$^2$ on a basis of silver, and further thereon was coated 1 g/m$^2$ of gelatin as a protective layer. Thus, the samples (1) to (20) set forth in Table 1 were prepared.

Each of these samples was exposed to light from a tungsten lamp at 3,200° K. through an optical wedge for sensito-metry for 5 seconds. Then, they were processed with a developing solution having the following composition at 38° C. for 30 seconds and then successively, subjected to fixation, washing and drying. (The development-processing was carried out using an automatic developing machine, FG-660F, a product of Fuji Photo Film Co., Ltd.)

Composition of Developing Solution

| | |
|---|---|
| Hydroquinone | 35.0 g |
| N—Methyl-p-aminophenol ½ Sulfate | 0.8 g |
| Sodium Hydroxide | 13.0 g |
| Potassium Tertiary Phosphate | 74.0 g |
| Potassium Sulfite | 90.0 g |
| Disodium Ethylenediaminetetraacetate | 1.0 g |
| Potassium Bromide | 4.0 g |
| 5-Methylbenzotriazole | 0.6 g |
| 3-Diethyl-1,2-propanediol | 15.0 g |

-continued

| | |
|---|---|
| Water to make | 1 liter (pH adjusted to 11.6) |

Photographic characteristics obtained are shown in Table 1. Therein, the relative sensitivity is determined relatively using the reciprocal of exposure necessary to attain the image density of 1.5, and the contrast (γ) is represented by a gradient obtained by averaging in the density region of 0.3 to 3.0. The extent of black spots was evaluated in five grades. Namely, black spots appearing in the unexposed areas of the sample were observed and counted through a magnifying glass of 25 magnifications. In Table 1, an emulsion virtually free from black spots was ranked as grade 5, and an emulsion having the greatest number of black spots was ranked as the grade 1. A grade 3 or higher indicates that the emulsion was fit for practical use.

The grade of the black spots can also be phrased as follows:

| |
|---|
| 5 - black spots substantially cannot be seen |
| 4 - |
| 3 - number of black spots is about 100 to 300 per $cm^2$ |
| 2 - |
| 1 - |

TABLE 1

| Sample No. | Emulsion Used: Emulsion A | Emulsion Used: Emulsion B | Compound (I): Kind | Compound (I): Amount used* | Relative Sensitivity | Contrast (γ) | $D_{max}$ | Grade of Black Spots |
|---|---|---|---|---|---|---|---|---|
| 1 | 100% | 0% | — | — | 40 | 3.38 | 4.5 | 5 |
| 2 | 70 | 30 | — | — | 56 | 3.25 | 4.3 | 5 |
| 3 | 50 | 50 | — | — | 66 | 3.07 | 4.0 | 5 |
| 4 | 0 | 100 | — | — | 100Tp | 2.84 | 3.6 | 5 |
| 5 | 100 | 0 | I-12 | $4 \times 10^{-3}$ | 355 | 16.9 | 4.6 | 5 |
| 6 | 70 | 30 | I-12 | $4 \times 10^{-3}$ | 537 | 15.9 | 4.5 | 4 |
| 7 | 50 | 50 | I-12 | $4 \times 10^{-3}$ | 631 | 15.0 | 4.3 | 4 |
| 8 | 0 | 100 | I-12 | $4 \times 10^{-3}$ | 661 | 13.5 | 3.8 | 3 |
| 9 | 100 | 0 | I-12 | $5 \times 10^{-3}$ | 447 | 18.0 | 4.9 | 4 |
| 10 | 70 | 30 | I-12 | $5 \times 10^{-3}$ | 776 | 18.0 | 4.7 | 4 |
| 11 | 50 | 50 | I-12 | $5 \times 10^{-3}$ | 851 | 16.9 | 4.5 | 3 |
| 12 | 0 | 100 | I-12 | $5 \times 10^{-3}$ | 794 | 15.0 | 3.8 | 2 |
| 13 | 100 | 0 | I-27 | $6 \times 10^{-4}$ | 468 | 19.3 | 5.0 | 4 |
| 14 | 70 | 30 | I-27 | $6 \times 10^{-4}$ | 851 | 19.3 | 4.8 | 3 |
| 15 | 50 | 50 | I-27 | $6 \times 10^{-4}$ | 891 | 18.0 | 4.5 | 3 |
| 16 | 0 | 100 | I-27 | $6 \times 10^{-4}$ | 891 | 15.9 | 3.9 | 2 |
| 17 | 100 | 0 | I-29 | $6 \times 10^{-4}$ | 468 | 20.8 | 5.1 | 4 |
| 18 | 70 | 30 | I-29 | $6 \times 10^{-4}$ | 832 | 20.8 | 4.9 | 3 |
| 19 | 50 | 50 | I-29 | $6 \times 10^{-4}$ | 891 | 19.3 | 4.7 | 3 |
| 20 | 0 | 100 | I-29 | $6 \times 10^{-4}$ | 851 | 15.9 | 4.0 | 1 |

*mole per mole of silver
Tp: made as standard

The samples (6), (7), (10), (11), (14), (15), (18) and (19) prepared by mixing Emulsion A and Emulsion B and further adding Compound (I) thereto in accordance with the present invention exhibited sensitivities on the same level with those of the samples (8), (12), (16) and (20) prepared using only Emulsion B of the high speed type, and showed an increased contrast and a heightened $D_{max}$. In addition, the generation of black spots in each of the samples according to the present invention was on a lower level than in the comparative samples. Accordingly, the present invention has proved to have excellent effects.

While the invention has been described in detail and with reference to specific embodiments thereof, it will be apparent to one skilled in the art that various changes and modifications can be made therein without departing from the spirit and scope thereof.

What is claimed is:

1. A silver halide photographic material comprising at least one negative type silver halide emulsion layer coated on a support, said emulsion comprising two kinds of monodisperse emulsions each having a mean grain size of not more than 0.5 micron and, differing in mean grain size from each other at least by 0.1 micron, and said photographic material further comprising a hydrazine derivative in at least one photographic layer, wherein one of said monodisperse emulsions has a mean grain size of not more than 0.3 micron and the other has a mean grain size of at least 0.3 micron, wherein the fraction of the finer-grained silver halide ranges from 40 to 90% by weight based on the weight of the total amount of silver halide in the monodisperse emulsions, wherein said hydrazine derivative is a compound selected from the group consisting of compounds represented by formulae (I) and (II):

$$R_1—NHNH—G—R_2 \quad (I)$$

wherein $R_1$ represents an aliphatic group, an aromatic group or a saturated heterocyclic group; $R_2$ represents a hydrogen atom, a substituted or unsubstituted alkyl group, a substituted or unsubstituted aryl group, a substituted or unsubstituted aralkyl group, a substituted or unsubstituted alkoxy group, or a substituted or unsubstituted aryloxy group; and G represents a carbonyl group, a sulfonyl group, a sulfoxy group, a phosphoryl group, or a N-substituted or unsubstituted iminomethylene group, and

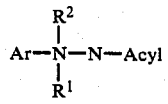

(II)

wherein;

"Acyl" is an acyl group,

"Ar" is an aryl group, $R^1$ represents a hydrogen atom and sulfinic acid radical substituent, and $R^2$ is chosen to be a sulfinic acid radical substituent when $R^1$ is a hydrogen atom and a hydrogen atom when $R^1$ is a sulfonic acid radical, wherein said hydrazine derivative is present in a contrast-enhancing amount.

2. A silver halide photographic material as in claim 1, wherein said two kinds of monodisperse emulsions differ in mean grain size from each other by from 0.1 to 0.3 micron.

3. A silver halide photographic material as in claim 1, wherein the mean grain size of the monodisperse emulsion of finer-grained silver halide is not less than 0.1 micron.

4. A silver halide photographic material as in claim 1, wherein an emulsion other than the monodisperse emulsion is contained in said silver halide emulsion in an amount of not more than 10% by weight based on the weight of the total amount of silver halide in the emulsion.

5. A silver halide photographic material as in claim 1, wherein said hydrazine derivative is one which is able to increase speed and contrast of a silver halide emulsion.

6. A silver halide photographic material as in claim 1, wherein said photographic layer is selected from the group consisting of a silver halide emulsion layer and an auxiliary layer.

7. A silver halide photographic material as in claim 1, wherein said hydrazine derivative is incorporated in said emulsion layer.

8. A silver halide photographic material as in claim 1, wherein the hydrazine derivative is incorporated in an auxiliary layer adjacent to said emulsion layer.

9. A silver halide photographic material as in claim 1, wherein the hydrazine derivative is incorporated in at least one photographic layer in an amount of from $1\times10^{-6}$ to $5\times10^{-2}$ mole per mole of silver halide in the photographic material.

10. A silver halide photographic material as in claim 1, wherein $R_1$ represents a substituted or unsubstituted straight or branched chain or cyclic alkyl group having from 1 to 20 carbon atoms in alkyl moiety, a substituted or unsubstituted saturated 3 to 10 membered heterocyclic group containing at least one of O, N and S atoms in the heterocyclic ring, a substituted or unsubstituted mono- or bicyclic aryl group, a substituted of unsubstituted 5 to 6 membered unsaturated heterocyclic group having at least one O, N and S atoms in the heterocyclic ring, and a heteroaryl group formed by fusing said 5 to 6 membered heterocyclic group with a mono- or bicyclic aryl group.

11. A silver halide photographic material as in claim 1, wherein G is a carbonyl group and $R_2$ is a group selected from the group consisting of a hydrogen atom, a methyl group, a methoxy group, an ethoxy group and a substituted or unsubstituted penyl group.

12. A silver halide photographic material as in claim 1, wherein G is a sulfonyl group and $R_2$ is a group selected from the group consisting of a methyl group, an ethyl group, a phenyl group or a 4-methylphenyl group.

13. A silver halide photographic material as in claim 1, wherein G is a phosphoryl group and $R_2$ is a group selected from the group consisting of a methoxy group, ethoxy group, a butoxy group, a phenoxy group, and a phenyl group.

14. A silver halide photographic material as in claim 1, wherein G is a sulfoxy group and $R_2$ is a group selected from the group consisting of a cyanobenzyl group and a methylthiobenzyl group.

15. A silver halide photographic material as in claim 1, wherein G is a substituted or unsubstituted iminomethylene group and $R_2$ is a group selected from the group consisting of a methyl group, an ethyl group and a substituted or unsubstituted phenyl group.

16. A silver halide photographic material as in claim 1, wherein one of said monodisperse emulsions has a mean grain size of not less than 0.1 micron to not more than 0.3 micron and the other has a mean grain size of at least 0.3 micron, wherein the fraction of the monodispersed emulsion having a mean grain size of not less than 0.1 micron to not more than 0.3 micron ranges from 40 to 90% by weight based on the weight of the total amount of silver halide in the monodisperse emulsions.

17. A silver halide photographic material as in claim 1, wherein one of said monodisperse emulsions has a mean grain size of not less than 0.1 micron to not more than 0.3 micron and the other has a mean grain size of at least 0.3 micron, wherein the fraction of the monodispersed emulsion having a mean grain size of not less than 0.1 micron to not more than 0.3 micron ranges from 40 to 90% by weight based on the weight of the total amount of silver halide in the monodisperse emulsions, further wherein the hydrazine derivative is incorporated in at least one photographic layer in an amount of from $1\times10^{-6}$ to $5\times10^{-2}$ mol per mol of silver halide in the photographic material.

18. A silver halide photographic material as in claim 1, wherein said two kinds of monodisperse emulsions meet the following emulsion grain size and amount limitations where the larger grain size is represented by S1 and the finer grain size is represented by S2, where all percents by weight are based on the weight of the total amount of silver halide in the monodisperse emulsions:

| | |
|---|---|
| $0.4\ \mu m < S1 \leqq 0.5\ \mu m$ | 10-30% |
| $0.1\ \mu m \leqq S2 \leqq 0.3\ \mu m$ | 90-70%. |

19. A silver halide photographic material as in claim 1, wherein said two kinds of monodisperse emulsions meet the following emulsion grain size and amount limitations where the larger grain size is represented by S1 and the finer grain size is represented by S2, where all percents by weight are based on the weight of the total amount of silver halide in the monodisperse emulsions:

| | |
|---|---|
| $S1 < 0.4\ \mu m$ | 10-60% |
| $S2 \leqq S1 - 0.1\ \mu m$ | 90-40%. |

20. A silver halide photographic material as in claim 1, wherein said two kinds of monodisperse emulsions meet the following emulsion grain size and amount limitations where the larger grain size is represented by S1 and the finer grain size is represented by S2, where all percents by weight are based on the weight of the total amount of silver halide in the monodisperse emulsions:

| | |
|---|---|
| $0.3\ \mu m \leqq S1 \leqq 0.4\ \mu m$ | 10-50% |
| $0.1\ \mu m \leqq S2 \leqq 0.3\ \mu m$ | 90-50%. |

* * * * *